US011427357B2

(12) United States Patent
Meyerhans et al.

(10) Patent No.: US 11,427,357 B2
(45) Date of Patent: Aug. 30, 2022

(54) METHOD AND DEVICE FOR BRINGING TOGETHER A WRAPPER AND A PLURALITY OF INSERTS TO FORM AN ADVERTISING MEANS COMPILATION

(71) Applicant: Mueller Martini Holding AG, Hergiswil (CH)

(72) Inventors: Rolf Meyerhans, Reiden (CH); Roland Kost, Oftringen (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 17/098,614

(22) Filed: Nov. 16, 2020

(65) Prior Publication Data

US 2021/0061501 A1 Mar. 4, 2021

Related U.S. Application Data

(62) Division of application No. 15/000,066, filed on Jan. 19, 2016, now abandoned.

(30) Foreign Application Priority Data

Jan. 19, 2015 (CH) ..... 0007315

(51) Int. Cl.
*B65B 35/30* (2006.01)
*B65B 11/18* (2006.01)
(Continued)

(52) U.S. Cl.
CPC ..... *B65B 11/18* (2013.01); *B42C 9/0081* (2013.01); *B42F 1/00* (2013.01); *B65B 35/30* (2013.01);
(Continued)

(58) Field of Classification Search
CPC ..... B65B 11/06; B65B 11/18; B65B 49/16; B65H 39/055
(Continued)

(56) References Cited

U.S. PATENT DOCUMENTS 3,059,391 A 10/1962 Volks
3,894,905 A 7/1975 Ehlscheid
(Continued)

FOREIGN PATENT DOCUMENTS

CH 704241 A1 6/2012
DE 1217919 B 6/1966
(Continued)

OTHER PUBLICATIONS

U.S. Appl. No. 15/000,066, filed Jan. 19, 2016, pending.

*Primary Examiner* — Chelsea E Stinson
(74) *Attorney, Agent, or Firm* — Leydig, Voit & Mayer, Ltd.

(57) ABSTRACT

A method for bringing together a wrapper and a plurality of inserts can be used to form an advertising means compilation. In a region of a compilation section, the wrapper and the inserts are deposited on one another individually and in succession on a conveying element which is moved in a direction of transport. A leading edge of the wrapper is deposited offset relative to leading edges of the inserts so as to form an excess length of the wrapper. The inserts are deposited on one another, forming a stack, such that the leading edges of the inserts form a common fold edge. The excess length of the wrapper, which lies flat on the conveying element or on the stack of inserts, is folded around the fold edge and, at least in part, around the stack of inserts so as to form the advertising means compilation.

15 Claims, 6 Drawing Sheets

(51) Int. Cl.

| | |
|---|---|
| ***B65H 45/12*** | (2006.01) |
| ***B65H 39/055*** | (2006.01) |
| ***B65H 45/30*** | (2006.01) |
| ***B42F 1/00*** | (2006.01) |
| ***B42C 9/00*** | (2006.01) |
| ***B65B 49/16*** | (2006.01) |
| ***B65B 51/02*** | (2006.01) |

(52) U.S. Cl.
CPC ..... *B65B 49/16* (2013.01); *B65B 51/02* (2013.01); *B65H 39/055* (2013.01); *B65H 45/12* (2013.01); *B65H 45/30* (2013.01); *B65H 2301/4381* (2013.01); *B65H 2301/43827* (2013.01); *B65H 2404/693* (2013.01); *B65H 2406/122* (2013.01)

(58) Field of Classification Search
USPC ..... 53/461, 466
See application file for complete search history.

(56) References Cited

U.S. PATENT DOCUMENTS

| | | | | |
|---|---|---|---|---|
| 4,071,997 | A | 2/1978 | Gunther, Jr. et al. | |
| 5,475,968 | A | 12/1995 | Linder | |
| 6,892,514 | B2 | 5/2005 | Kragh | |
| 2003/0041571 | A1* | 3/2003 | Haller | B65B 25/14 53/569 |
| 2004/0159079 | A1* | 8/2004 | Kragh | B65B 25/14 53/466 |
| 2013/0026003 | A1* | 1/2013 | Meyerhans | B65H 39/055 198/347.2 |
| 2013/0280484 | A1 | 10/2013 | Honegger | |
| 2018/0015774 | A1 | 1/2018 | Meyerhans | |

FOREIGN PATENT DOCUMENTS

| | | | |
|---|---|---|---|
| DE | 10015485 | A1 | 10/2001 |
| EP | 588764 | A2 | 3/1994 |
| FR | 1483452 | A | 6/1967 |
| WO | WO 03008273 | A1 | 1/2003 |

* cited by examiner

METHOD AND DEVICE FOR BRINGING TOGETHER A WRAPPER AND A PLURALITY OF INSERTS TO FORM AN ADVERTISING MEANS COMPILATION

CROSS-REFERENCE TO PRIOR APPLICATION

This application is a U.S. Divisional patent application of U.S. patent application Ser. No. 15/000,066, which was filed on Jan. 19, 2016, and which claims priority to Swiss Patent Application No. CH 00073/15, filed on Jan. 19, 2015, the entire disclosure of each of which is hereby incorporated by reference herein.

FIELD

The invention relates to a method and to a device, in each case for bringing together a wrapper and a plurality of inserts to form an advertising means compilation.

BACKGROUND

A device and a method for bringing together a plurality of inserts and a wrapper are known from EP 588764 A2. The device has a first delivery station for the wrapper and a second delivery station for the inserts which have been assembled beforehand. In this case, this assembling of the inserts takes place on a collecting section with a plurality of feeders arranged in series which deposit the inserts withdrawn from one stack of identical inserts in each case on a conveying element in such a way that each subsequent feeder lays its insert on the insert(s) deposited by the previous feeder(s), forming a new stack with inserts arranged in the desired sequence. Between the two delivery stations there is arranged a drum-shaped conveying element, which rotates about a horizontal axis, with a plurality of receiving pockets.

First of all, a wrapper is introduced with its fold forward into one of the opened receiving pockets of the drum-shaped conveying element by means of the first delivery station. Thereafter, the receiving pocket is closed and the wrapper is transported through a lower conveying region as far as the second delivery station. Once the receiving pocket and the wrapper positioned therein have been opened again, the associated inserts are inserted. Finally, the product thus completed is removed upwards out of the receiving pocket and is taken away for further use.

In this manner, for example newspapers are produced, the wrapper forming the outer section and the inserts the inner sections of a newspaper in which advertising materials may additionally also be inserted. Latterly, such methods and devices have however also been increasingly used to combine advertising means from different suppliers, the advertising means usually consisting of single-layer or multi-layer printed pre-products, but also product samples, CDs etc. of different formats, and being introduced into a common wrapper.

Because of two separate delivery stations for the wrapper and the inserts being formed, and also because of the conveying element arranged therebetween, this device and the corresponding method are however relatively complex, and hence relatively expensive. In addition, the relatively large space requirement for the device is disadvantageous.

Alternatively to this, a method and a device for producing a composite consisting of advertising means lying loosely on one another or loosely against one another, in which the advertising means form a common stack edge and an adhesive element is attached to the stack edge and the two outer advertising means, is known from CH 704241 A1.

With this solution, additional costs are incurred for the application device and the adhesive element, and also a certain amount of time is required for applying the latter. In addition, such an adhesive element is not very visually appealing and scarcely offers any space for applying advertising. Furthermore, using an adhesive element is potentially disadvantageous if the machine jams. Finally, there is the risk that the two outer advertising means which are connected to the adhesive element and thus are fixed in their positions may be damaged during transport of the composite, and that their advertising value may be adversely affected thereby.

SUMMARY

In an embodiment, the present invention provides a method for bringing together a wrapper and a plurality of inserts to form an advertising means compilation. In a region of a compilation section, the wrapper and the inserts are deposited on one another individually and in succession on a conveying element which is moved in a direction of transport. A leading edge of the wrapper is deposited in the direction of transport offset relative to leading edges of the inserts so as to form an excess length of the wrapper relative to the inserts. The inserts are deposited on one another, forming a stack, such that the leading edges of the inserts at least approximately form a common fold edge. The excess length of the wrapper, which lies flat on the conveying element or on the stack of inserts, is folded around the fold edge and, at least in part, around the stack of inserts so as to form the advertising means compilation. The advertising means compilation is folded on the fold edge and is then transported off for further processing.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
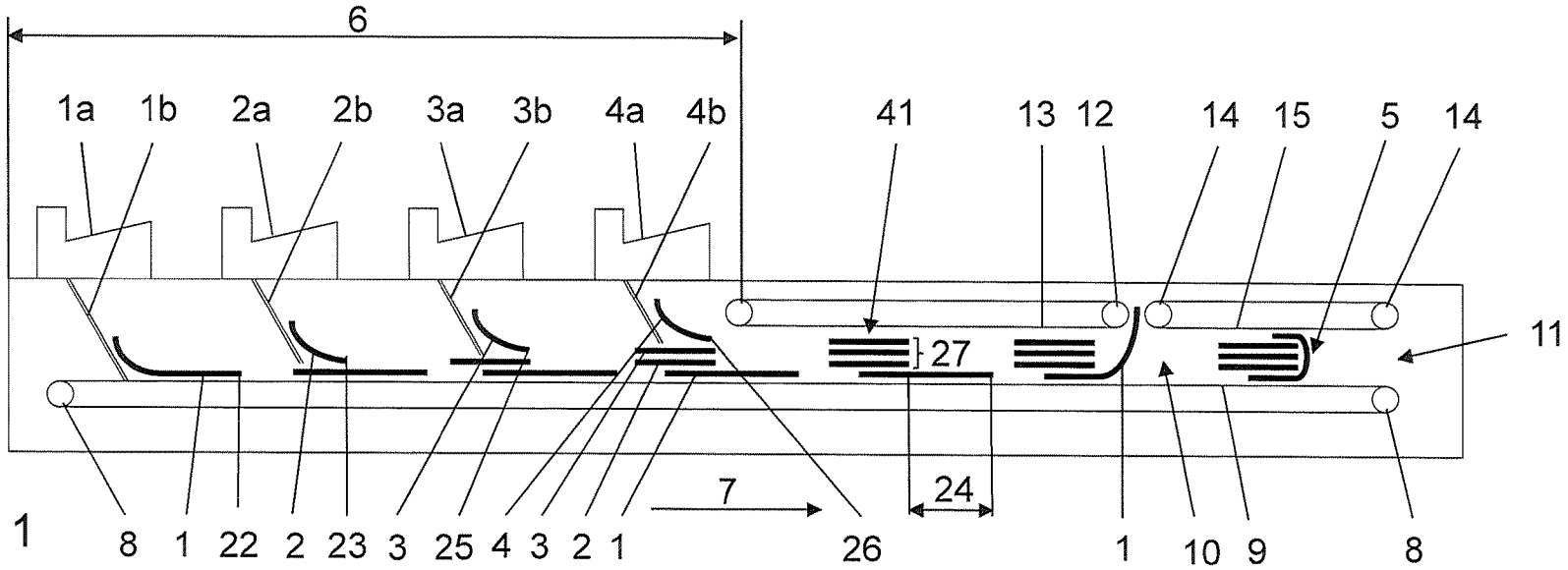
FIG. 1 is a side view of a device according to the invention in accordance with a first embodiment.

In an embodiment, the invention provides a space-saving, simple and inexpensive method and a corresponding device for bringing together a wrapper and a plurality of inserts to form an advertising means compilation.

In the method according to an embodiment of the invention, the wrapper and the inserts, in the region of a compilation section, are deposited on one another individually and in succession on a conveying element which is moved in a direction of transport. In so doing, a leading edge of the wrapper is deposited in the direction of transport offset relative to leading edges of the inserts, forming an excess length of the wrapper relative to the inserts. The inserts are deposited on one another, forming a stack, such that the leading edges of the inserts at least approximately form a common fold edge, the excess length of the wrapper which lies flat on the conveying element or on the stack of inserts being folded around this fold edge and also at least in part around the stack of inserts, forming the advertising means compilation. The advertising means compilation is then folded on the fold edge and finally transported off for further processing.

Because the wrapper is assembled on the same compilation section as the inserts and does not have to be opened in order to introduce the inserts, a space-saving, simple and inexpensive method for bringing together a wrapper and a plurality of inserts to form an advertising means compilation can be realised.

According to an advantageous embodiment of the method according to the invention, the excess length of the wrapper for folding around the fold edge and also at least in part around the stack of inserts of the advertising means compilation is advantageously transported by means of the conveying element into the region of a deflecting space, is acted upon there by a compressed-air jet or a mechanical deflecting element and is deflected into the deflecting space. Upon further transport of the wrapper in the direction of transport, the excess length of the wrapper is folded over on the fold edge counter to the direction of transport such that the excess length is laid against the stack of inserts.

Whereas the solution with the compressed-air jet advantageously does not have any mechanical source of jamming and thus is more fault-tolerant, the mechanical deflecting element proves advantageous in the case of multi-sided, stiff wrappers.

According to a further embodiment of the method according to the invention, the deposition of the wrapper on the conveying element takes place before the inserts belonging to the advertising means compilation are deposited. In this method, the wrapper advantageously forms a base for depositing the inserts.

At least one adhesive dot can be applied to the wrapper deposited on the conveying element in an intended region of overlap with the first insert before the first insert is laid. As a result, the wrapper can be prevented from lifting off from the inserts if the advertising means compilation during the further processing, such as for example during the joint stacking of a plurality of advertising means compilations, no longer lies on a support surface. Malfunctions during the subsequent further processing can thus be largely ruled out.

Once the last insert has been deposited, and before the excess length of the wrapper is folded around the common fold edge of the inserts and also at least in part around the stack of inserts, at least one further adhesive dot can be applied to the last insert in an intended region of overlap with the excess length of the wrapper. Owing to the application of the at least one further adhesive dot to the last insert, the wrapper can be prevented from resuming its original shape. Malfunctions during the subsequent further processing can thus be largely ruled out.

According to a further embodiment of the method according to the invention, the deposition of the wrapper takes place once the inserts belonging to the advertising means compilation have been deposited on the conveying element. Such a method is relatively independent of the way in which the inserts are assembled. They may for example already have been assembled beforehand in a separate operation before being jointly laid on the conveying element and provided with the wrapper.

With this embodiment, advantageously once the last insert has been deposited and before the wrapper is laid on the last insert, at least one adhesive dot can be applied to the last insert in an intended region of overlap with the wrapper. Owing to the application of the at least one adhesive dot to the last insert, the wrapper can be prevented from lifting off from the inserts if the advertising means compilation during the further processing, such as for example during the joint stacking of a plurality of advertising means compilations, is no longer limited upwards by a conveying element arranged above it. Malfunctions during the subsequent further processing can thus be largely ruled out.

Once the first insert has been deposited, and before the excess length of the wrapper is folded around the common fold edge of the inserts and also at least in part around the stack of inserts, at least one further adhesive dot can be applied to the first insert in an intended region of overlap with the excess length of the wrapper. Owing to the application of the at least one further adhesive dot to the first insert, the wrapper can be prevented from resuming its original shape. Malfunctions during the subsequent further processing can thus be largely ruled out.

According to a further embodiment of the method according to the invention, at least one imprint can be applied to the folded advertising means compilation. Such an imprint may advantageously be used to control the further processing, or for addressing, personalising or regionalising the advertising means compilation.

The device according to an embodiment of the invention has a compilation section with a conveying element which is movable in a direction of transport. A plurality of individualisation and supply elements for the wrapper and the inserts are arranged in succession along the compilation section. The individualisation and supply elements are designed such that a leading edge of the wrapper can be deposited offset relative to leading edges of the inserts in the direction of transport, forming an excess length of the wrapper relative to the inserts. A deflecting space and a deflecting device which introduces the excess length of the wrapper into the deflecting space are arranged downstream from the compilation section. The conveying element, at least in the region of the deflecting space, is designed such that both the wrapper and the inserts lie flat on the conveying element. A folding device for the advertising means compilation is arranged downstream from the deflecting space. Finally, a removal device for the advertising means compilation is arranged downstream from the folding device.

Such a device for bringing together a wrapper and a plurality of inserts to form an advertising means compilation has a comparatively simple structure and can therefore be produced inexpensively. In addition, the device is designed in a space-saving manner.

According to one embodiment of the device according to the invention, the deflecting device is designed as a compressed-air jet or as a mechanical deflecting element. Whereas a compressed-air jet designed as a deflecting device advantageously does not form a mechanical source of jamming and thus is more fault-tolerant, the deflecting device designed as a mechanical deflecting element proves advantageous in the case of multi-sided, stiff wrappers.

According to a further embodiment of the device according to the invention, first of all the individualisation and supply element for the wrapper and thereafter the individualisation and supply elements for the inserts is/are arranged along the compilation section. If because of this configuration of the compilation section first the wrapper and thereafter the inserts is/are supplied, the latter can advantageously be laid on the wrapper.

In this embodiment, a first gluing device can be arranged on the compilation section, between the individualisation and supply element for the wrapper and the individualisation and supply element for the first insert. Application of at least one adhesive dot to the wrapper which takes place with the first gluing device means that the wrapper can be prevented from lifting off from the inserts if the advertising means compilation during the further processing, such as for example during the joint stacking of a plurality of advertising means compilations, no longer lies on a support surface. Malfunctions during the subsequent further processing can thus be largely ruled out.

A second gluing device may be arranged on the compilation section, between the individualisation and supply element for the last insert and the deflecting space. Owing to the arrangement of this second gluing device and the application of at least one further adhesive dot to the last insert which takes place with this gluing device, the wrapper can be prevented from resuming its original shape. Malfunctions during the subsequent further processing can thus be largely ruled out.

According to a further embodiment of the device according to the invention, first of all the individualisation and supply elements for the inserts and thereafter the individualisation and supply element for the wrapper are/is arranged along the compilation section. Thus an alternative technical solution is offered which may be technically and/or economically advantageous, depending on the specific requirements of the respective producer of the advertising means compilation.

In this embodiment too, a first gluing device may be arranged on the compilation section, between the individualisation and supply element for the last insert and the individualisation and supply element for the wrapper. Owing to the arrangement of the first gluing device and the application of the at least one adhesive dot to the last insert which takes place with this gluing device, the wrapper can be prevented from lifting off from the inserts if the advertising means compilation during the further processing, such as for example during the joint stacking of a plurality of advertising means compilations, is no longer limited upwards by a conveying element arranged above it. Malfunctions during the subsequent further processing can thus be largely ruled out.

A second gluing device may be arranged on the compilation section, between the individualisation and supply element for the first insert and the deflecting space. Owing to the arrangement of the second gluing device and the application of at least one further adhesive dot to the first insert which takes place with this gluing device, the wrapper can be prevented from resuming its original shape. Malfunctions during the subsequent further processing can thus be largely ruled out.

The folding device arranged downstream from the deflecting space has two cooperating conveying elements arranged one above the other. Thus the folding of the advertising means compilation can be realised in a particularly simple manner. In addition, the advertising means compilation formed beforehand is advantageously fixed both from above and from below during folding.

According to FIG. 1, the device for bringing together a wrapper 1 and a plurality of advertising means designed as inserts 2, 3, 4 to form an advertising means compilation 5 has a compilation section 6 along which a number of individualisation and supply elements 1*a*, 2*a*, 3*a*, 4*a* designed as feeders are arranged above a first conveying element 9 formed as a conveyor belt which is guided in a direction of transport 7 about deflecting rolls 8. Downstream from the compilation section 6 there is arranged a folding device 10 for folding the wrapper 1, and further downstream a removal device 11 for the advertising means compilation 5.

Figure 2:
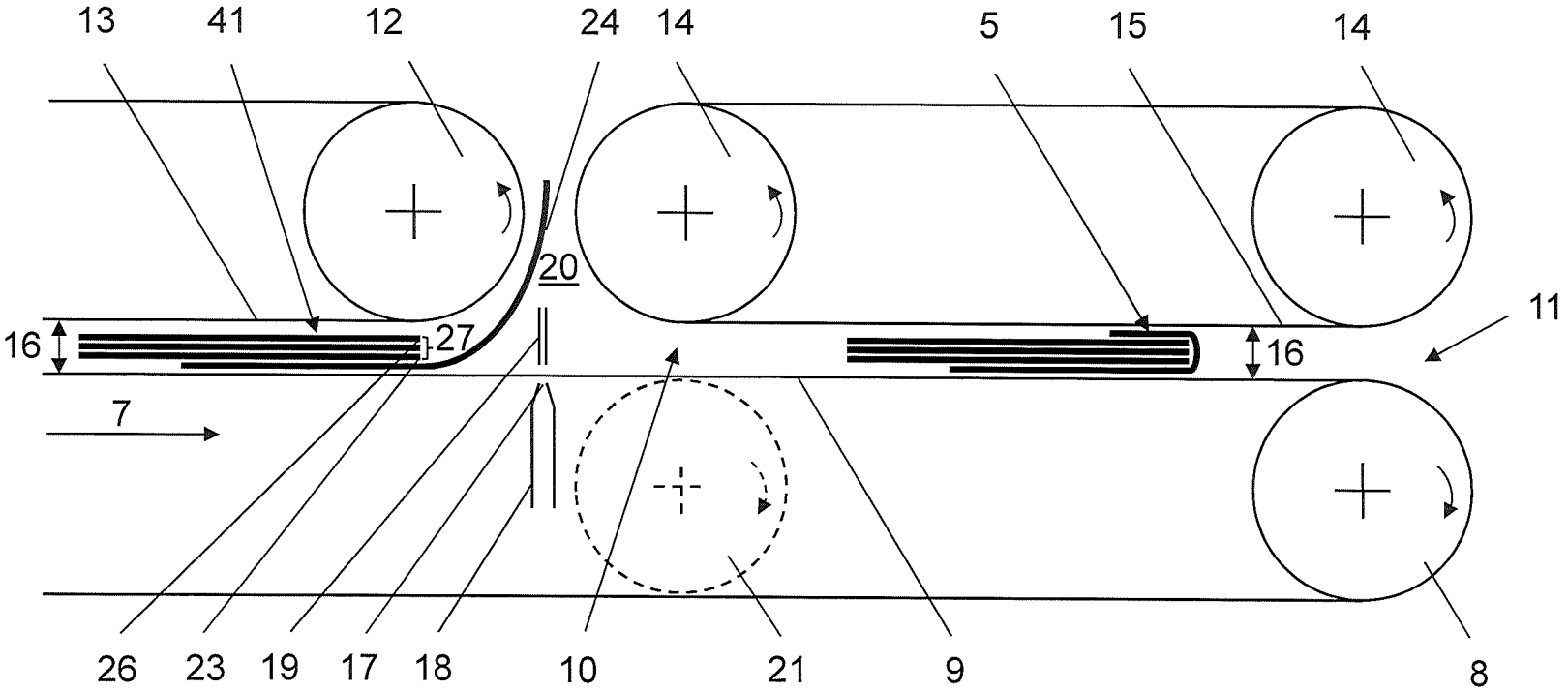
FIG. 2 is an enlarged view of a region downstream from the collecting section, with a first variant of deflection of the wrapper.

As shown in the enlarged view of FIG. 2, a second conveying element 13 arranged above the first conveying element 9 and spaced apart therefrom which revolves about deflecting rolls 12 and is likewise designed as a conveyor belt, and also a third conveying element 15 arranged above the first conveying element 9 and spaced apart therefrom which revolves about deflecting rolls 14 and adjoins the second conveying element 13 in the direction of transport 7 and is likewise designed as a conveyor belt, is arranged downstream from the compilation section 6. In such case, the conveying elements 9, 13, 15 may in each case have a single conveyor belt or a plurality of conveyor belts formed with gaps. Of course, chains, toothed belts or similar conveying devices may also be formed as conveying elements 9, 13, 15.

Between the second conveying element 13 and the first conveying element 9, or between the third conveying element 15 and the first conveying element 9, there is formed in each case a substantially identical vertical spacing 16 which corresponds to the thickness of the advertising means compilation 5 and can be adapted automatically to a different thickness of the advertising means compilation 5 of a subsequent production order by corresponding lowering of the first conveying element 9.

The third conveying element 15 which revolves about the deflecting rolls 14 and adjoins the second conveying element 13 in the direction of transport 7, and also that part of the first conveying element 9 which is arranged beneath the third conveying element 15, belong to the folding device 10 arranged downstream from the compilation section 6.

Between the compilation section 6 and the folding device 10, more precisely between the downstream deflecting roll 12 of the second conveying element 13 and the upstream deflecting roll 14 of the third conveying element 15, and hence above the first conveying element 9, there is arranged a deflecting space 20. In the region of the first conveying element 9 there is arranged a deflecting device 18, designed as a compressed-air feed, which is connected to a compressed-air source and has at least one outlet opening 17. In order to control a compressed-air jet 19 emerging from the at least one outlet opening 17, for example a solenoid valve may be arranged in a compressed-air line connected to the compressed-air source and the compressed-air feed, and may be connected to a machine control. In this case, the at least one outlet opening 17 and hence also the compressed-air jet 19 is directed at the deflecting space 20 arranged above the deflecting device 18. Beneath the upstream deflecting roll 14 of the third conveying element 15, there may in addition be arranged a press roll 21 for pressing the advertising means compilation 5 which cooperates with the deflecting roll 14.

The removal device 11 for the advertising means compilation 5 is formed by the first conveying element 9 and the third conveying element 15 or the downstream deflecting rolls 8, 14 thereof. Downstream from the removal device 11 there may be arranged a diverter for discarding incomplete or faulty advertising means compilations 5.

During operation of the device, by means of the first individualisation and supply element 1*a*, first of all a wrapper 1 is individualised from a stack of wrappers and is deposited between two guide members 1*b* which are merely indicated in FIG. 1 or along a single guide member in a defined position on the first conveying element 9 (FIG. 1). The deposition takes place at at least approximately the same speed as the speed of progress of the first conveying element 9.

In this case, the wrapper 1 may actually be a separate wrapper either without, or advantageously provided with, printed advertisements and/or other information, but may also directly be an advertising means in the form of a preconfigured multi-page printed sheet analogous to the inserts 2, 3, 4.

In a next step, by means of the second individualisation and supply element 2*a*, a first insert 2 is separated out of a stack of first inserts 2 and is deposited offset counter to the direction of transport 7 between two guide members 2*b* which are merely indicated in FIG. 1 or along a single guide member on the wrapper 1 which is already located on the first conveying element 9 and which is conveyed in the direction of transport 7, such that a leading edge 22 of the wrapper 1 has an excess length 24 in the direction of transport 7 relative to a leading edge 23 of the first insert 2. If the individualisation and supply elements 1*a*, 2*a* have a separate individual drive in each case, this offset of the wrapper 1 or of the first insert 2 can be realised by correspondingly controlling the respective individual drive. In the case of a central drive for all the individualisation and supply elements 1*a*, 2*a*, 3*a*, 4*a*, an overriding drive can be used for this purpose in each case. In such case, the necessary offset is expediently already realised upon the deposition of the wrapper 1 on the first conveying element 9, so that displacement of the inserts 2, 3, 4 upon the deposition thereof is unnecessary.

In a further step, by means of the third individualisation and supply element 3*a*, a second insert 3 is separated out of a stack of second inserts 3 and is deposited between two guide members 3*b* which are merely indicated in FIG. 1 or along a single guide member on the wrapper 1 which is already located on the first conveying element 9 and which is conveyed in the direction of transport 7, and the first insert 2 which lies offset thereon, forming a stack 41, such that the leading edge 23 of the first insert 2 and a leading edge 25 of the second insert 3 are oriented substantially flush with one another in the direction of transport 7.

In a next step, by means of the fourth individualisation and supply element 4*a*, a third insert 4 is separated out of a stack of third inserts 4 and is deposited between two guide members 4*b* which are merely indicated in FIG. 1 or along a single guide member on the wrapper which is already located on the first conveying element 9 and which is conveyed in the direction of transport 7 and the first and second inserts 2, 3 which lie offset thereon, on the stack 41 such that the leading edge 23 of the first insert 2, the leading edge 25 of the second insert 3 and a leading edge 26 of the third insert 4 are oriented substantially flush with one another in the direction of transport 7.

The leading edges 23, 25, 26 of the first, second and third inserts 2, 3, 4 which are offset relative to the leading edge of the wrapper 1 and are oriented substantially flush with one another form at least approximately a common fold edge 27 around which the excess length 24 of the wrapper 1 is folded in a next operating step which takes place in the folding device 10. In this case, first of all the leading excess length 24 of the wrapper 1 is acted upon downstream from the compilation section 6 by the compressed-air jet 19 and is deflected upwards into the region of the deflecting space 20 between the downstream deflecting roll 12 of the second conveying element 13 and the upstream deflecting roll 14 of the third conveying element 15 (FIG. 2). Upon further transporting of the wrapper 1 and the inserts 2, 3, 4 which lie offset thereon in the direction of transport 7, the fold edge 27 of the inserts 2, 3, 4 which is formed by the leading edges 23, 25, 26 is pressed against the lower region of the upward-deflected excess length 24 of the wrapper 1, so that the excess length 24 is finally folded around this common fold edge 27 and also at least in part around the stack 41 of inserts 2, 3, 4 by the action of the deflecting roll 14 of the third conveying element 15 as well. The advertising means compilation 5 formed in this manner from the wrapper 1 and the inserts 2, 3, 4 which lie therein is conveyed further in the direction of transport 7 between the first conveying element 9 and the third conveying element 15, and in so doing is folded on the fold edge 27 and finally removed for further processing in the region of the removal device 11.

Figure 12:
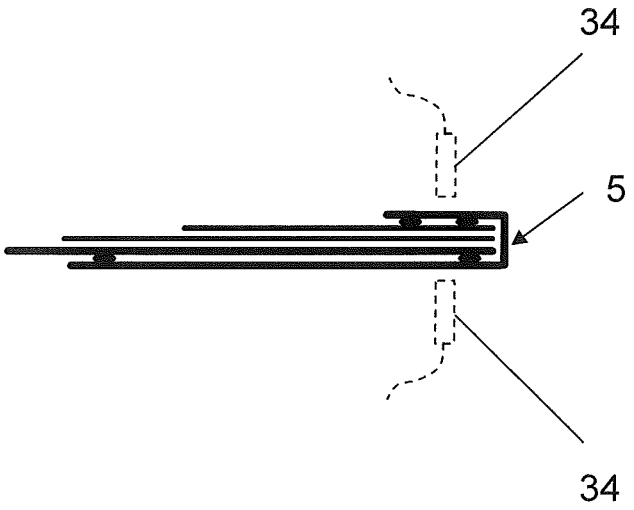
FIG. 12 shows an advertising means compilation thus formed with optional personalisation by applying text or barcodes.

The further processing may for example be the film-wrapping of individual advertising means compilations or joint stacking of a plurality of advertising means compilations with or without subsequent film-wrapping, but also simply transporting to a temporary store. For this purpose, the advertising means compilation 5 may first of all be provided with machine-readable and/or with human-readable information, for example with information on the further processing, on the delivery or for the recipient, and may also be personalised or regionalised, by means of an inkjet printer 34 (FIG. 12). In addition, the advertising means compilation 5 may also be electrostatically blocked in order to prevent displacement of the inserts 2, 3, 4 in a subsequent further-processing process.

Figure 3:
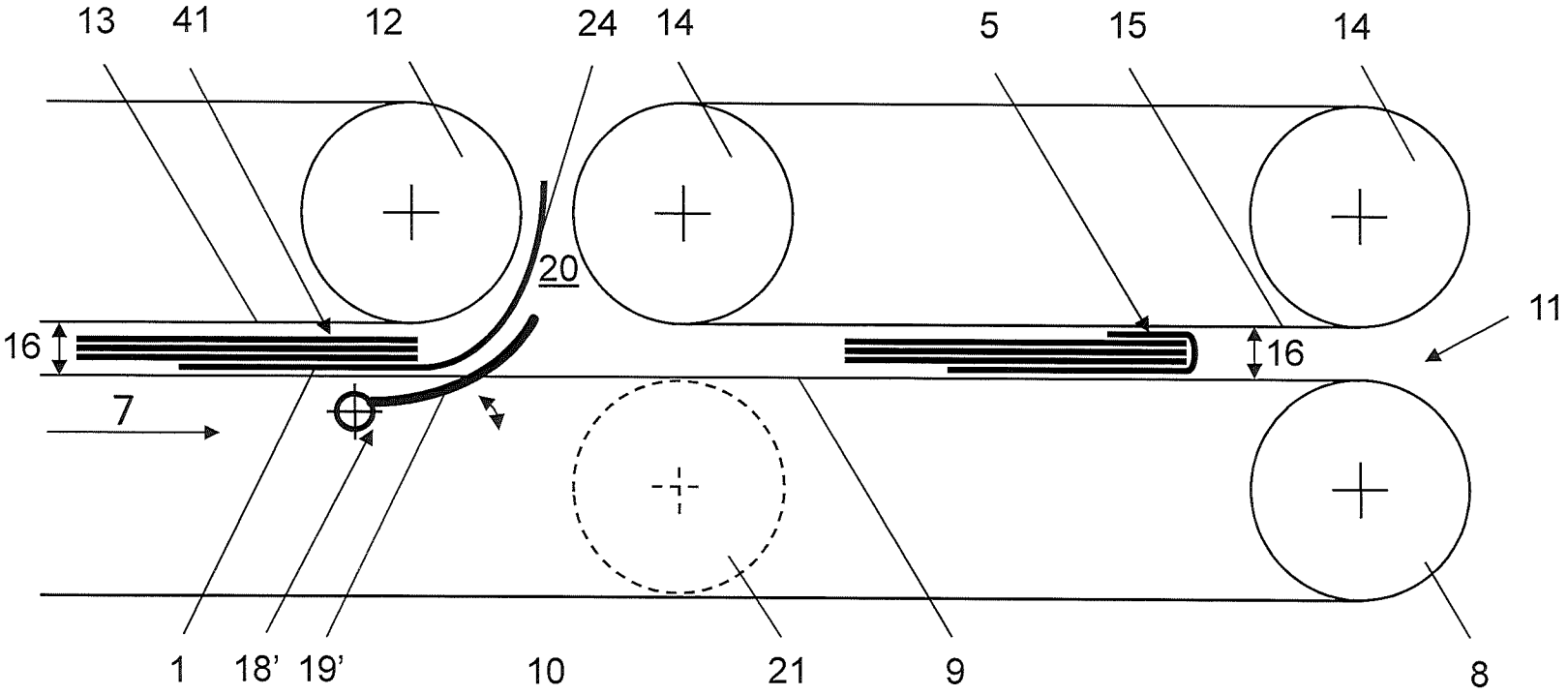
FIG. 3 is a view analogous to FIG. 2, but with a second variant of the deflection of the wrapper.

FIG. 3 shows an alternative variant for deflecting the excess length 24 of the wrapper 1 into the deflecting space 20. Instead of the deflecting device 18 used in a solution according to FIG. 2, which releases a compressed-air jet 19, a for example pneumatically operated deflecting device 18' designed as a mechanical deflecting element 19' is arranged here which is pivoted into or moved into the conveying path of the wrapper 1 if required.

Of course, the compilation section 6 is not restricted to the number of three individualisation and supply elements 2*a*, 3*a*, 4*a* for the inserts 2, 3, 4 illustrated in FIG. 1 and described previously, but, depending on the order range of the producer of the advertising means compilation 5, may have any number whatsoever of individualisation and supply elements 2*a*, 3*a*, 4*a* for inserts 2, 3, 4. Likewise, it is not inevitably the first individualisation and supply element 1*a* which has to be used for supplying the wrapper 1. Rather, in each case the first individualisation and supply element which feeds the conveying element 9 supplies the wrapper 1. In other words, it may happen that the first and also further individualisation and supply elements are not operated, so that for example the second individualisation and supply element 2 in the direction of transport 7 or alternatively an individualisation and supply element 3, 4 arranged farther downstream supplies the wrapper 1. Likewise, when the order changes immediately following the preceding production order or at a different time therefrom, any other individualisation and supply element 1*a*, 2*a*, 3*a*, 4*a* whatsoever which is provided with corresponding wrappers 1 may begin supplying a wrapper 1 to the first conveying element 9 and any subsequent individualisation and supply elements whatsoever may then apply inserts. Because of the folding device 10 which is connected to the machine control, it can be selectively decided depending on the production order whether the bringing together of a wrapper 1 and a plurality of inserts 2, 3, 4 to form an advertising means compilation 5 previously described is to take place or whether they are to pass through the folding device 10 without a folding operation. In such case, for example an insert 2, 3, 4 which is not combined with a wrapper 1 to form an advertising means compilation 5 can be positioned beneath or above an advertising means compilation 5 during the further processing and be delivered jointly therewith to a customer. Of course, in this manner very widely-varying combinations of advertising means compilations 5 and additional inserts 2, 3, 4 can be produced.

Alternatively to an individualisation and supply element 1*a* used for a wrapper 1 and or to one or a plurality of individualisation and supply elements 2*a*, 3*a*, 4*a* used for inserts 2, 3, 4, the collecting section 6 may of course also be connected directly to one or more printing presses, in particular digital printing presses, and be fed with the wrapper 1 or with inserts 2, 3, 4 thereby.

Although the respective wrapper 1 and the associated inserts 2, 3, 4 have been illustrated spaced apart from one another in the figures for drawing reasons, they actually lie on one another. Likewise, the spacing of the respective wrapper 1 and the associated inserts 2, 3, 4 from the respective conveying device is merely dictated by drawing-related considerations, i.e. the partial products/products are actually acted upon with a conveying effect by the respective conveying device.

In FIGS. 5 to 12, the working steps for the production of an advertising means compilation 5 are illustrated schematically with a device corresponding to FIG. 1, with further additional options also being shown.

Figure 5:
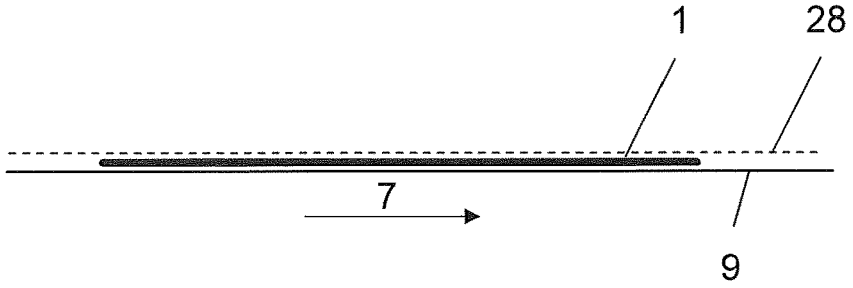
FIG. 5 is a schematic view of the wrapper which is deposited on a conveying element and conveyed in the direction of transport in accordance with the first embodiment.

According to FIG. 5, the wrapper 1 which is withdrawn from the individualisation and supply element 1*a* and deposited on the first conveying element 9 is conveyed in the direction of transport 7. Optionally, a further conveying element 28 may also be arranged above the wrapper 1, with which element slipping of the wrapper 1 on the first conveying element 9 can be prevented effectively. The further conveying element 28 and the second conveying element 13 may be combined to form a single conveying element.

Figure 6:
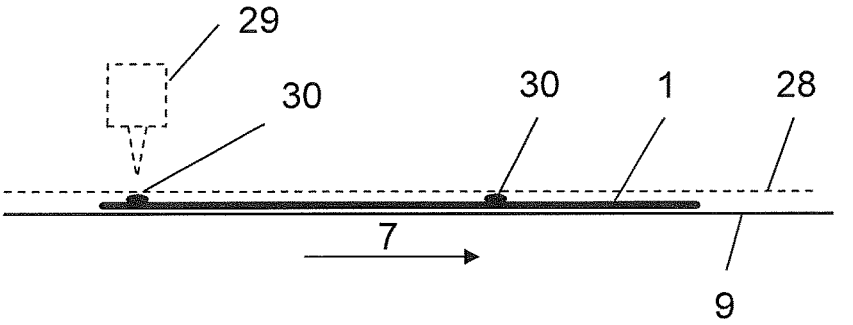
FIG. 6 is a view according to FIG. 5, but additionally with two adhesive dots optionally applied to the wrapper.

Corresponding to FIG. 6, a first gluing device 29 may be arranged between the first individualisation and supply element 1*a* and the second individualisation and supply element 2*a* and also above the first conveying element 9, by means of which gluing device at least one adhesive dot 30, but preferably two adhesive dots 30, can be applied to the wrapper 1, in a later region of overlap with the first insert 2. In such case, the at least one adhesive dot 30 is applied through the gaps in the conveying element 9. The adhesive dot or dots 30 serve(s) for later stabilisation of the wrapper 1 during further processing.

Figure 7:
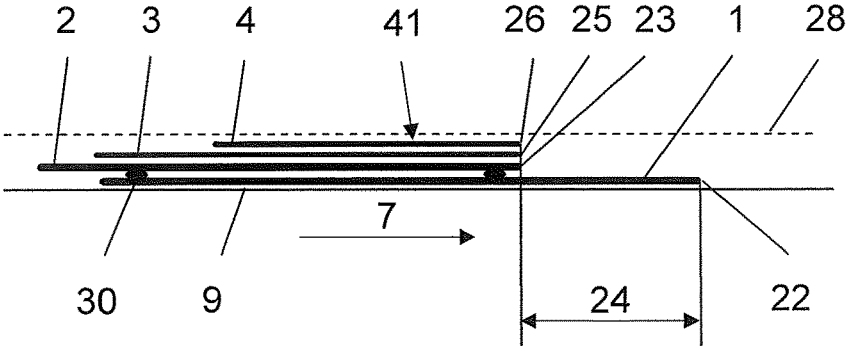
FIG. 7 is a view according to FIG. 6, but additionally with three inserts on the wrapper and laid offset on the wrapper counter to the direction of transport.

FIG. 7 shows the inserts 2, 3, 4 applied by means of the individualisation and supply elements 2*a*, 3*a*, 4*a* offset relative to the wrapper 1 which is conveyed on the first conveying element 9 in the direction of transport 7. In addition, the excess length 24 of the leading edge 22 of the wrapper 1 relative to the leading edges 23, 25, 26 of the inserts 2, 3, 4 is clear.

Figure 8:
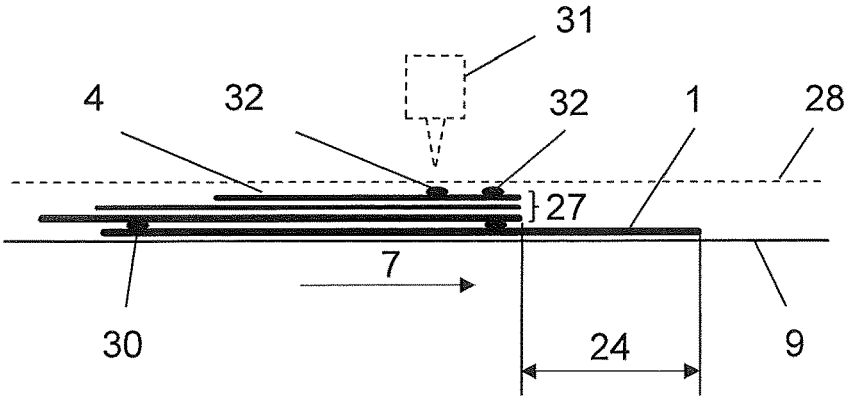
FIG. 8 is a view according to FIG. 7, but additionally with two adhesive dots optionally applied to the last insert.

Corresponding to FIG. 8, a second gluing device 31 may be arranged between the fourth individualisation and supply element 4*a* and the folding device 10 and also above the first conveying element 9, by means of which gluing device at least one further adhesive dot 32, but preferably two further adhesive dots 32, can be applied to the last, i.e. in the example illustrated the third, insert 4. These adhesive dots 32 likewise serve for later stabilisation of the wrapper 1 during further processing. Alternatively to the application of the adhesive dots 30, 32, an at least partially self-adhesive wrapper may also be used.

Figure 9:
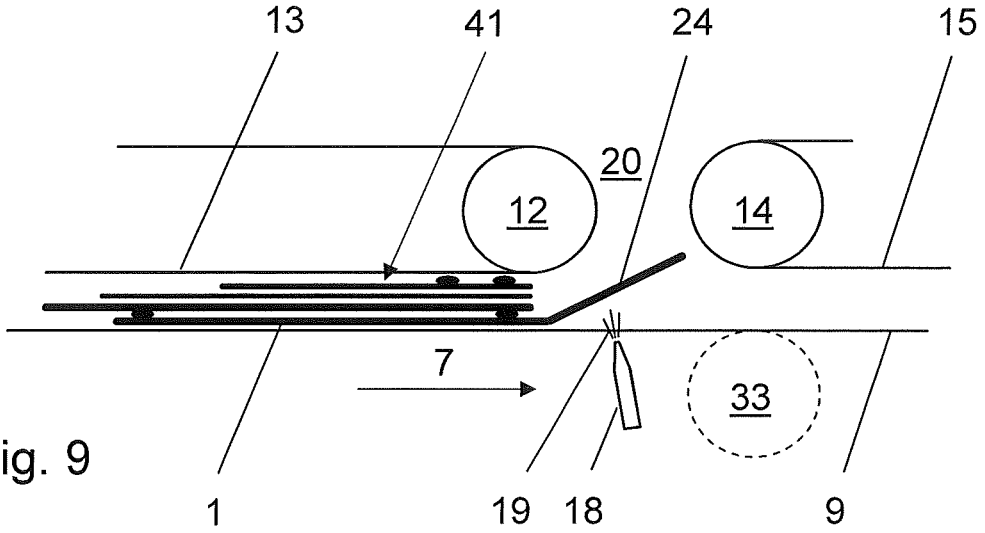
FIG. 9 is a view according to FIG. 8, but additionally with a deflection which has taken place upwards of the excess length of the wrapper relative to the inserts.

FIG. 9 shows the deflection, which takes place upwards by means of the compressed-air jet 19 from the deflecting device 18, of the excess length 24 of the wrapper 1 into the deflecting space 20 between the downstream deflecting roll 12 of the second conveying element 13 and the upstream deflecting roll 14 of the third conveying element 15.

Figure 10:
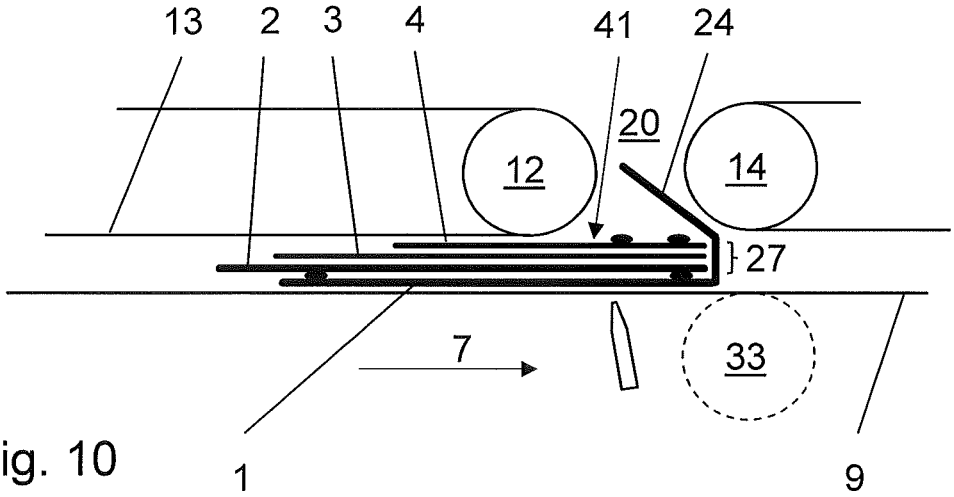
FIG. 10 is a view according to FIG. 9, in which the deflected excess length of the wrapper is additionally further folded over by folding rolls.

FIG. 10 shows the folding-over of the excess length 24 of the wrapper 1 which is transported further in the direction of transport 7, which takes place by means of the upstream deflecting roll 14 of the third conveying element 15, around the fold edge 27 of the inserts 2, 3, 4 which lie offset on the wrapper 1.

Figure 11:
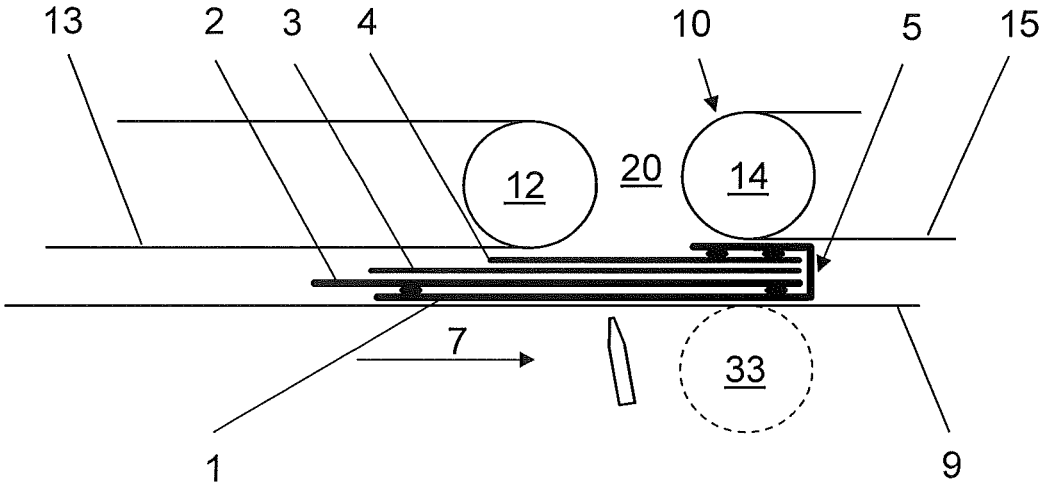
FIG. 11 is a view according to FIG. 10, in which the folding rolls have folded the excess length region of the wrapper around the inserts and have thus formed an advertising means compilation.

According to FIG. 11, the wrapper 1 and the inserts 2, 3, 4 which lie thereon are conveyed further in the direction of transport 7, so that the excess length 24 of the wrapper 1 which is folded over around the fold edge 27 is folded between the first conveying element 9 and the third conveying element 15 and thus forms the advertising means compilation 5 consisting of the wrapper 1 and the inserts 2, 3, 4. Optionally, beneath the upstream deflecting roll 14 of the third conveying element 15, which roll is additionally designed as a folding roller, there may be arranged a folding roller 33 which cooperates therewith to fold the advertising means compilation 5 over its full area. Alternatively to this, two folding rollers arranged downstream from the folding device 10 are also conceivable.

FIG. 12 shows the optional arrangement of inkjet printers 34 in the region downstream from the folding device 10. In this manner, the advertising means compilation 5 can be personalised for example by a corresponding printed address or by printing on a barcode containing the delivery address.

Figure 4:
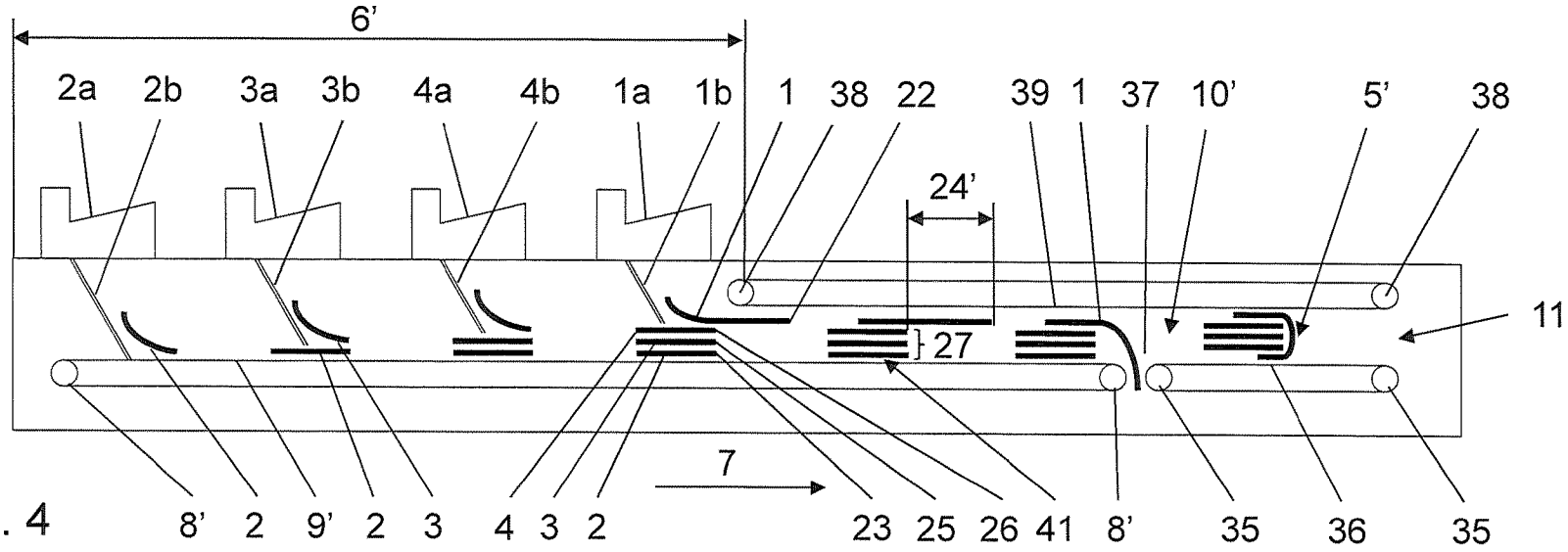
FIG. 4 is a side view of a device according to the invention in accordance with a second embodiment.

FIG. 4 shows a second embodiment in which the wrapper 1, in contrast to the first embodiment illustrated in FIGS. 1 to 3 and 5 to 12, is only withdrawn from a stack with the last individualisation and supply element 4*a* of a compilation section 6', and is deposited on a stack already previously formed from the inserts 2, 3, 4 and transported on the first conveying element 9', such that the leading edge 22 of the wrapper 1 in the direction of transport 7 is arranged offset relative to the leading edges 23, 25, 26, arranged one above the other, of the inserts 2, 3, 4, forming an excess length 24'.

The first conveying element 9', which is likewise guided about deflecting rolls 8', ends downstream from the compilation section 6'. Downstream from the first conveying element 9' and spaced apart therefrom there is arranged a fourth conveying element 36, which likewise revolves about deflecting rolls 35 and is likewise designed as a conveyor belt. Between a downstream deflecting roll 8' of the first conveying element 9' and an upstream deflecting roll 35 of the fourth conveying element 36 there is formed a deflecting space 37. Above the two conveying elements 9', 36 and spaced apart therefrom there is arranged a fifth conveying element 39 which overlaps these two conveying elements 9', 36 and revolves about deflecting rolls 38, and is likewise designed as a conveyor belt. The fourth conveying element 36 and the fifth conveying element 39 jointly form a folding device 10'.

Figure 13:
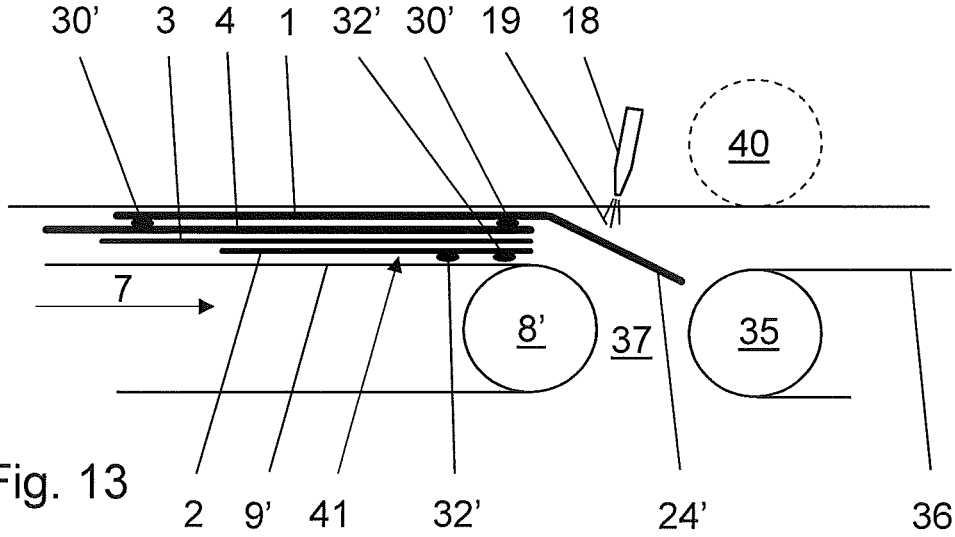
FIG. 13 shows analogously to FIG. 9 the step of the deflection of the offset, which has taken place downwards, of the wrapper relative to the inserts to produce an advertising means compilation corresponding to the second embodiment illustrated in FIG. 4.

Analogously to FIG. 9 for the first example, FIG. 13 shows, for the second example, the deflection, which takes place by means of the compressed-air jet 19 from the deflecting device 18, but here downwards, of the excess length 24' of the wrapper 1 into the deflecting space 37 between the downstream deflecting roll 8' of the first conveying element 9' and the upstream deflecting roll 35 of the fourth conveying element 36.

As illustrated in FIG. 4, the wrapper 1 and the inserts 2, 3, 4 which lie thereon are thereafter conveyed further in the direction of transport 7, so that the excess length 24 of the wrapper 1 folded over around the fold edge 27, and hence the advertising means compilation 5' consisting of the wrapper 1 and the inserts 2, 3, 4, is folded between the fourth conveying element 36 and the fifth conveying element 39. Optionally, above the upstream deflecting roll 35 of the fourth conveying element 36, which roll is additionally designed as a folding roller, there may be arranged a folding roller 40 which cooperates therewith to fold the advertising means compilation 5' over its full area (FIG. 13). Alternatively to this, two folding rollers arranged downstream from the folding device 10' are also conceivable.

Figure 14:
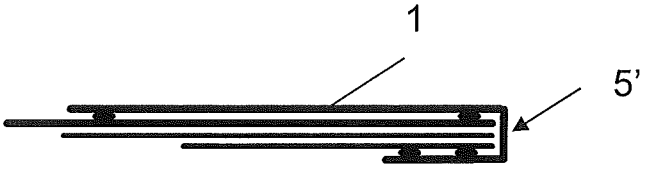
FIG. 14 shows an advertising means compilation produced corresponding to the second embodiment illustrated in FIG. 4.

FIG. 14 shows an advertising means compilation 5' formed with a device according to the second embodiment, which differs from the advertising means compilation 5 produced with a device according to the first embodiment merely with regard to the positioning of the wrapper 1 which is folded around the inserts 2, 3, 4. Likewise and with the same effect as in the case of the advertising means compilation 5, at least one first adhesive dot 30' and at least one further adhesive dot 32' can be used in the production of the advertising means compilation 5'. Both advertising means compilations 5, 5' can be processed further substantially identically.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for bringing together a wrapper and a plurality of inserts to form an advertising compilation using a device, the device comprising a first individualisation and supply element for depositing the wrapper, a plurality of second individualisation and supply elements arranged in succession for depositing the plurality of inserts, and a conveyor, the method comprising executing a continuous process comprising the successive steps of:

depositing the wrapper in a region of a compilation section on the conveyor via the first individualisation and supply element, the conveyor being moved in a direction of transport;

depositing a first insert of the plurality of inserts on the wrapper via one of the second individualization and supply elements, such that a leading edge of the first insert is offset relative to a leading edge of the wrapper so as to form an excess length of the wrapper relative to the first insert;

depositing successively a second insert of the plurality of inserts on the first insert via another of the second individualization and supply elements, forming at least part of a stack, such that a leading edge of the second insert is offset relative to the leading edge of the wrapper so as to form the excess length of the wrapper relative to the second insert and such that the leading edge of the second insert and the leading edge of the first insert at least approximately form a common fold edge;

folding the excess length of the wrapper, which lies flat on the conveyor, around the common fold edge and, at least in part, around the stack of inserts so as to form the advertising compilation; and folding the advertising compilation on the common fold edge; and then transporting the advertising compilation off for further processing.

2. The method according to claim 1, wherein, for the folding around of the excess length of the wrapper, the excess length is transported by the conveyor into a region of a deflecting space, the excess length being acted upon in the region of the deflecting space by a compressed-air jet or a mechanical deflecting element so as to be deflected into the deflecting space, then the wrapper is transported in the direction of transport such that the excess length is folded over on the fold edge counter to the direction of transport and the excess length is laid against the stack of the inserts.

3. The method according to claim 1, further comprising applying at least one adhesive dot to the wrapper deposited on the conveyor in an intended region of overlap with the first insert before the first insert is laid.

4. The method according to claim 1, further comprising, after the deposition of a last one of the inserts and before the folding of the excess length of the wrapper, applying at least one adhesive dot to a last one of the inserts in an intended region of overlap with the excess length of the wrapper.

5. The method according to claim 1, further comprising, after the deposition of the first insert and before the folding of the excess length of the wrapper, applying at least one adhesive dot to the first insert in an intended region of overlap with the excess length of the wrapper.

6. The method according to claim 1, further comprising applying at least one imprint to the folded advertising compilation.

7. The method according to claim 1, wherein, in the direction of transport along the compilation section, the first individualisation and supply element is arranged first prior to the second individualisation and supply elements.

8. The method according to claim 7, the method further comprising applying glue, by a first gluing device arranged on the compilation section between the first and second individualisation and supply elements, on the wrapper.

9. The method according to claim 8, the method further comprising applying glue, by a second gluing device arranged on the compilation section between one of the second individualisation and supply elements and the deflecting space, on a last one of the inserts.

10. The method according to claim 1, the method further comprising applying glue, by a first gluing device arranged on the compilation section between the first and second individualisation and supply elements, on a last one of the inserts.

11. The method according to claim 10, the method further comprising applying more glue, by a second gluing device arranged on the compilation section between a second individualisation and supply element and the deflecting space, on the first insert.

12. The method according to claim 1, wherein the folding of the excess length of the wrapper is performed by a folding device having two cooperating conveyors arranged one above the other.

13. The method according to claim 1, wherein:

the first insert of the plurality of inserts is deposited on the wrapper such that a trailing edge of the first insert is offset relative to a trailing edge of the wrapper, and the second insert of the plurality of inserts is deposited on the first insert such that a trailing edge of the second insert is offset relative to the trailing edge of the wrapper.

14. A method for bringing together a wrapper and a plurality of inserts to form an advertising compilation using a device, the device comprising a plurality of first individualisation and supply elements arranged in succession for depositing the plurality of inserts in a region of a compilation section on a conveyor, and a last individualisation and supply element for depositing the wrapper, the conveyor configured to move in a direction of transport, the method comprising executing a continuous process comprising the successive steps of:

depositing a first insert of the plurality of inserts on the compilation section of the conveyor via one of the first individualization and supply elements;

successively depositing a second insert of the plurality of inserts on the first insert via another of the first individualization and supply elements, forming at least part of a stack, such that a leading edge of the inserts at least approximately form a common fold edge;

depositing the wrapper on the stack of the plurality of inserts via the last individualisation and supply element, such that the leading edge of the inserts are offset relative to a leading edge of the wrapper so as to form an excess length of the wrapper relative to the inserts;

folding the excess length of the wrapper, which lies on the stack of inserts, around the common fold edge and, at least in part, around the stack of inserts so as to form the advertising compilation; and folding the advertising compilation on the common fold edge; and then transporting the advertising compilation off for further processing.

15. The method according to claim 14, the method further comprising applying at least one adhesive dot to a last one of the inserts in an intended region of overlap with the wrapper.

* * * * *